United States Patent [19]

Maruyama et al.

[11] 4,226,165

[45] Oct. 7, 1980

[54] FISHING NET

[75] Inventors: Jiro Maruyama, Hakodate; Seiji Suzuki, Yokkaichi, both of Japan

[73] Assignee: Hakodate Seimo Sengu Co., Ltd., Japan

[21] Appl. No.: 965,105

[22] Filed: Nov. 30, 1978

Related U.S. Application Data

[62] Division of Ser. No. 752,848, Dec. 21, 1976, Pat. No. 4,139,225.

[30] Foreign Application Priority Data

Dec. 23, 1975 [JP] Japan ..... 50/152891

[51] Int. Cl.[3] ..... D04G 1/02; A01K 69/02

[52] U.S. Cl. ..... 87/12; 289/1.2

[58] Field of Search ..... 87/12, 57; 43/7, 10, 43/14; 289/1.5, 1.2, 2, 18

[56] References Cited

U.S. PATENT DOCUMENTS

| | | | |
|---|---|---|---|
| 2,590,586 | 3/1952 | Thompson, Jr. et al. | 87/12 X |
| 2,619,704 | 12/1952 | Frontel | 87/12 X |
| 2,641,951 | 6/1953 | Sonnberger | 87/12 |
| 2,653,372 | 9/1953 | Johnson et al. | 87/12 X |
| 2,732,750 | 1/1956 | Sonnberger | 87/12 |
| 2,823,575 | 2/1958 | Needham et al. | 87/12 X |
| 3,995,898 | 12/1976 | Momoi | 87/12 X |
| 4,003,289 | 1/1977 | Yamashita | 87/12 |

*Primary Examiner*—John Petrakes

*Attorney, Agent, or Firm*—Ostrolenk, Faber, Gerb & Soffen

[57] ABSTRACT

A fishing net and a method for making the same. The net of the invention has a plurality of improved knots, each of which knots has four leg strings extending separately in four directions and one or both of the loops of warp and weft overlie each crotch formed of a pair of adjoining leg strings. Further, the knots are easily formed and tightened but hardly loosened or worn so that a well-ordered diamond pattern of the net is always formed when the net is spread.

3 Claims, 24 Drawing Figures

FIG.6
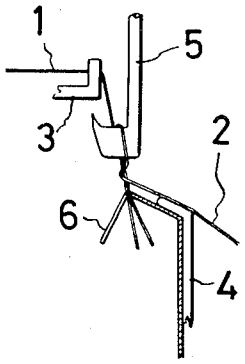
FIG.7
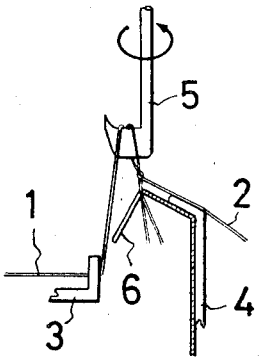
FIG.8
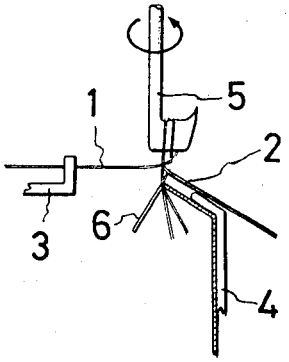
FIG.9
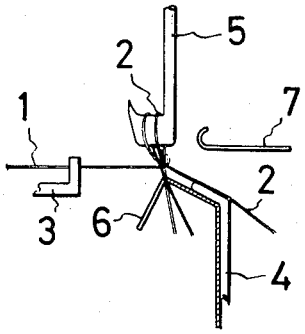
FIG.10
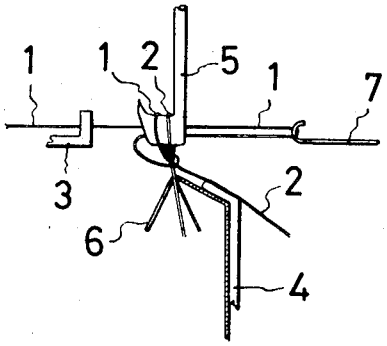
FIG.11
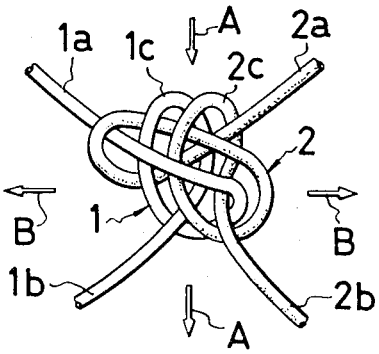
FIG.12
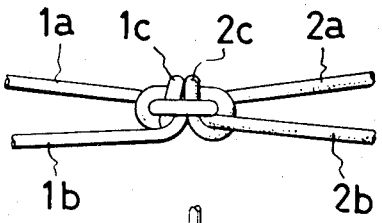
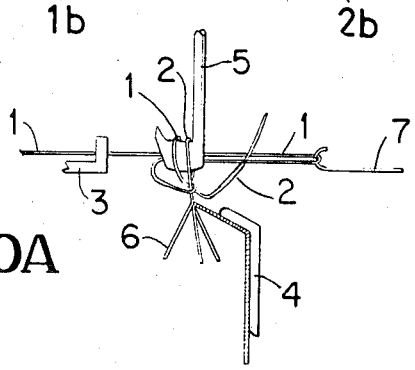
FIG.10A FIG.17
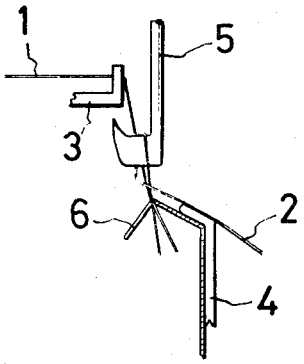
FIG.18
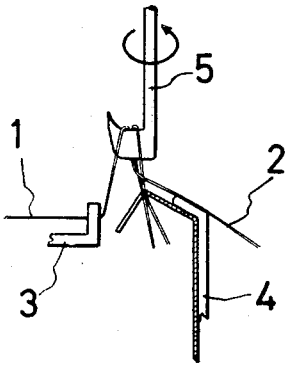
FIG.19
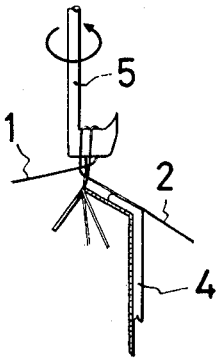
FIG.20
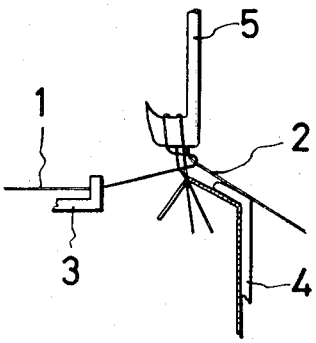
FIG.21
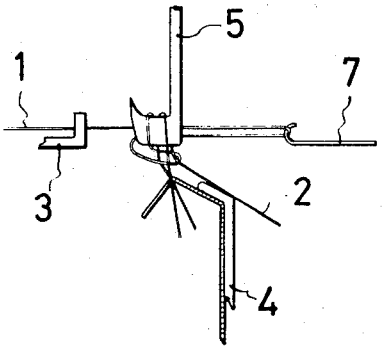
FIG.22
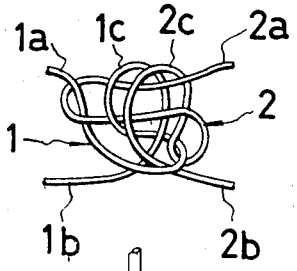
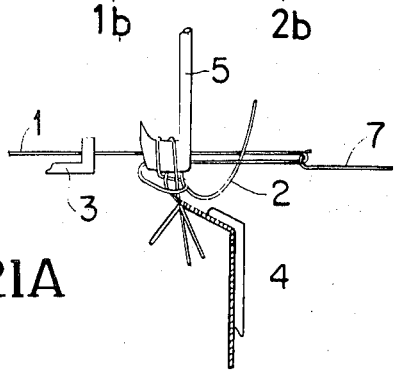
FIG.21A

FISHING NET

This is a Division of application Ser. No. 752,848 filed Dec. 21, 1976, now U.S. Pat. No. 4,139,225.

BACKGROUND OF THE INVENTION

This invention relates to a fishing net and a method for making the same. More particularly, the invention relates to a gill net made of monofilament and a method for forming the knots of the gill net.

The fishing net, particularly, the gill net is generally spread in the water like a curtain and fish are entangled in the net. The fish caught by the net make great efforts with their bodies so as to get away. Accordingly, the knots in the gill net must not loosen and the knot portions must not snap. Further, the net meshes must neither twist nor shrink and they should keep a well-ordered diamond pattern in order to get a good catch of fish.

The most important thing in making several fishing nets is the formation of the knots of the meshes. A great variety of knots are known for satisfying the above requirements. However, there is no fully satisfactory knot since conventional knots are designed to prevent the loosening of knots of nets but not much consideration has been given to the chafing of the leg strings of the net owing to the entanglement of the knots. In addition, the tightening of knots cannot be performed smoothly and the arrangement of the knots is liable to become irregular. Further, in some fishing nets, the knots are easily overturned and the net is partially shrunk or entangled, so that when the net is spread in use, the meshes of the net do not form a well-ordered diamond pattern. This causes the fish to feel fear resulting in the reduction of fish catch. Furthermore, the leg strings of knots are placed in the positions in which excessive forces are caused to occur during knot tightening. Therefore the knots are liable to become large and the knot tightening work cannot be done smoothly.

BRIEF SUMMARY OF THE INVENTION

The present invention eliminates the above-disclosed disadvantages.

The primary object of the present invention is therefore to provide a fishing net having a plurality of improved knots and a method for making the net.

Another object of the invention is to provide a fishing net which can be spread into a well-ordered diamond pattern and the knots of which net are hardly loosened or damaged.

A further object of the invention is to provide a method for making the knots of fishing nets and in which the improved knots can be easily intertwined and evenly tightened.

In accordance with the present invention, each knot of the fishing net has four leg strings extending separately in four directions and one or both loops of warp and weft overlie each crotch formed of a pair of adjoining leg strings. Therefore, the knots can be easily and evenly tightened by pulling four leg strings and the tightened knots are hardly loosened, chafed or entangled.

The method of the invention for making the above-described fishing net comprises the steps of: hanging a warp on an upper hook; rotating the upper hook and hanging a weft on the upper hook; reversely rotating the upper hook and removing the warp from the upper hook, thereby entwining the warp with the weft; hanging the warp on the upper hook from the direction opposite to the removing of the warp in the former step; after rotating the upper hook once, pulling the warp by a lower hook to form a bight and passing the bight of warp over the weft on a bobbin; and detaching the warp and weft from the upper hook and tightening thus intertwined warp and weft.

BRIEF DESCRIPTION OF THE DRAWINGS

These and other objects and features of the invention will become more apparent from the following description taken in connection with the accompanying drawings in which:

FIGS. 1 to 10A are schematic illustrations of the steps in the knot-making process in sequence according to the method of the present invention;

FIG. 11 is an enlarged detail view of a knot in untightened condition formed through the process as shown in the preceding Figures;

FIG. 12 is an enlarged view of the same knot as in FIG. 11 in the tightened and finished condition;

FIGS. 13 to 21A are schematic illustrations of the steps in another knot-making process in sequence according to the method of the present invention; and FIG. 22 is an enlarged detail view of a knot in untightened condition formed through the process as shown in FIGS. 13 to 22.

DETAILED DESCRIPTION OF THE INVENTION

Figure 1:
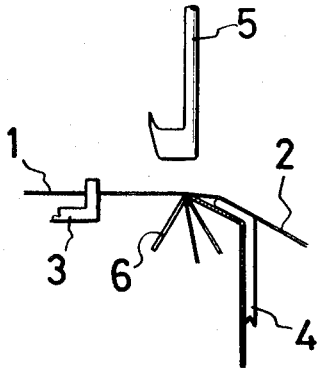
Figure 2:
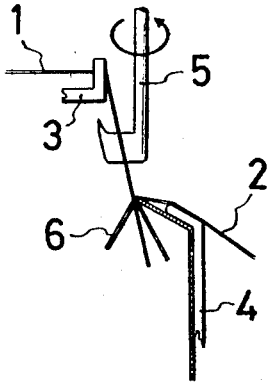

Referring now to the accompanying drawings, the fishing net and the method for manufacturing the same according to the present invention is described in detail in the following.

A first net manufacturing method is illustrated in FIGS. 1 to 10. A warp is indicated by a reference numeral 1 and a weft, by a reference numeral 2. The warp 1 can be moved up and down and right and left by a reed 3, and the weft 2 is moved up by a lifting plate 4. Though it is not shown in the drawings, the weft 2 is wound round a shuttle. The reference numeral 5 indicates an upper hook which is one of the main tools for making knots of the net. A guide hook 6 is used for supporting a formed net, that is the tied knots of the net are caught by this guide hook 6.

Figure 3:
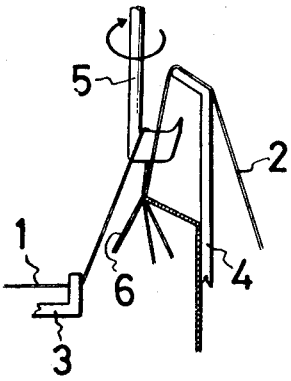
Figure 4:
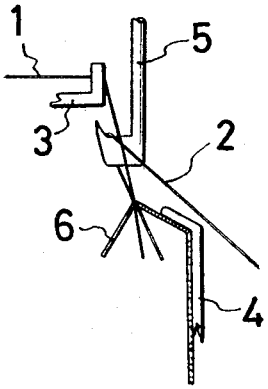
Figure 5:
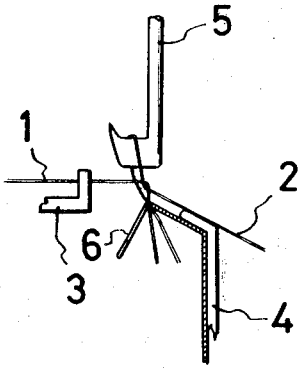

In the method for making the net of the invention, a warp 1 is lifted up by a read 3 (FIG. 2) and the warp 1 is hung on an upper hook 5 from the right to the left (counterclockwise as viewed from the side of the tip end of the hook). The upper hook 5 then makes a half turn or a little more to the left (counterclockwise rotation when viewed from above). The weft 2 is then lifted up by a lifting plate 4 and hung on the upper hook 5 from the left to the right with a half turn to the right of the upper hook 5 (FIG. 3). By the above steps, the warp 1 and the weft 2 are hung on the upper hook 5 from different sides. Simultaneously with the above right half turn, the reed 3 is moved up (FIG. 4) to lift the warp 1 up and release it from the upper hook 5 (FIG. 5), thereby twining the warp 1 to the weft 2. Then the reed 3 is moved in the reverse direction to apply the warp 1 to the upper hook 5 from the left to the right just like the weft 2 (FIGS. 6 and 7). The upper hook 5 then rotates once to the left (FIGS. 8 and 9) and the loop of the warp 1 at the portion where the warp is not held by the upper hook is pulled forth away from the upper hook by a lower hook 7 (FIG. 10). The weft 2 is then passed through the bight or loop of the warp 1 (FIG. 10A) and after that the warp 1 and the weft 2 are taken off from the upper hook 5. The entwined strings are then pulled together to be tightened and to obtain a knot.

In FIG. 11, the intertwined state of the warp and weft of the above obtained knot is shown. The reference numerals 1*a* and 1*b* indicate the legs of warp 1 and 2*a* and the numerals 2*b*, the legs of weft 2. The characteristic features of this knot are that the loop 1*c* of warp and the loop 2*c* of weft run parallel to each other, the loop 1*c* of warp is positioned on the side of the reed (the left in the drawing) and that the loop 2*c* of weft is positioned on the side of the lower hook (the right in the drawing). Further, the legs 1*a*, 1*b*, 2*a* and 2*b* are extended in four separate directions, and one or both of the loops pass over the crotch of each pair of adjoining legs of the knot strings. Thus each leg can be properly separated from any of the other legs by the crotch-passing loop. When the legs 1*a*, 1*b*, 2*a* and 2*b* are pulled simultaneously to tighten up the knot, the loops 1*c* and 2*c* can be smoothly and evenly contracted, whereby tightening of the knot can be done quickly.

The knots of the net of the invention are formed in the direction of the arrows A in FIG. 11 (hereinafter referred to as "knot-making direction") and after the knot making, the formed net is extended in the directions of the arrows B in FIG. 11 (hereinafter referred to as "net finishing direction") which is perpendicular to the knot-making direction. The net extended in the net-finishing direction B is finally set by thermal setting treatment. In this treatment, since each component string leg extends separately in its own direction and the loop of string overlies in each crotch of legs as disclosed above, the tightened knot can be made narrow in the net-finishing direction B as shown in FIG. 12. Therefore, the knots of the net can be made small and stable, and when the net is expanded in use, all the meshes of the net form a well-ordered diamond pattern.

Figure 13:
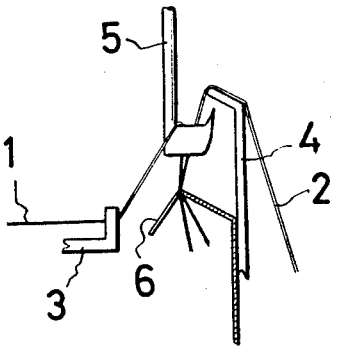
Figure 14:
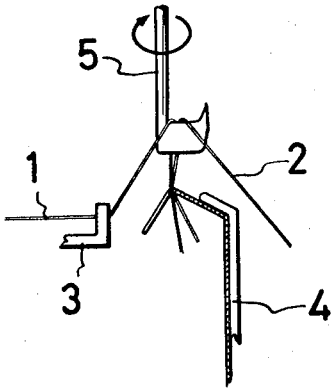
Figure 15:
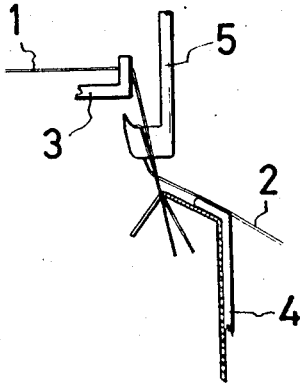
Figure 16:
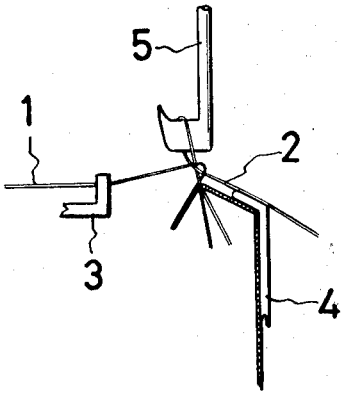

A variation of the net manufacturing method of the present invention is illustrated in FIGS. 1, 2 and 13 to 21. Similarly to the foregoing method, a warp 1 is lifted up by a reed 3 (FIG. 2) in the first place, and the warp 1 is hung on a upper hook 5 from the right to the left. The upper hook 5 is then turned through a half turn or a little more to the left. At the same time, the weft 2 is lifted up by a lifting plate 4 and the weft 2 is applied to the upper hook 5 from the right to the left (FIGS. 13 and 14). In this step, the warp 1 and the weft 2 are hung on the upper hook 5 from the same side. Simultaneously with the half rotation of the upper hook 5 in the direction reverse to the above rotation, the wrap 1 is released from the upper hook 5 by raising the reed 3 (FIGS. 15 and 16). Then the warp 1 is hung on the upper hook 5 from the left to the right by moving the reed 3 in the reverse direction from the former movement (FIGS. 17 and 18). Further, the upper hook 5 is rotated once to the left. FIG. 19 shows the state after a half counterclockwise rotation and FIG. 20 shows the state after one rotation of the upper hook 5. The warp 1 is then pulled, at the portion thereof where the warp is not hung on the upper hook, by a lower hook 7 (FIG. 21) thereby defining a loop of the warp and the weft 2 is passed through the loop on bight of the pulled warp 1 (FIG. 21A). After that, both the warp 1 and the weft 2 are taken off the upper hook 5. The knot of the invention is obtained by tightening the above intertwined strings.

The knot formed according to the above method is shown in FIG. 22 in the untightened condition. Just like the aforementioned knot formed by the first method, the loop 1*c* of the warp 1 and the loop 2*c* of the weft 2 of this knot run in parallel to each other and the loop 1*c* is positioned on the side of the reed and the loop 2*c* is positioned on the side of the lower hook. Further, the legs 1*a*, 1*b*, 2*a* and 2*b* separately extend in four directions. Thus, when the knot is tightened by pulling the four leg strings, the knot can be smoothly and evenly tightened without causing any irregularity.

As disclosed above, the loops of warp and weft overlie each crotch of adjoining leg strings of the knot. Further, the leg strings are directed toward heat-setting directions, so that the formed knot is hardly overturned or shifted and the loosening or stretching of the net strings can be prevented. Accordingly, the net having the knots of the invention can be always spread smoothly forming a well-ordered diamond pattern and the catch of fish can be increased. Further, the knot formed according to the method of the invention can be easily and evenly tightened into a stable knot and the shape of the knot is small and narrow in the net-finishing direction, so that a neat but durable net can be formed.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A fishing net having a plurality of knots formed by intertwining warps and wefts, each of said knots comprising:

(a) a section of said warp and a section of said weft intertwined therewith;

(b) opposite ends of said warp section defining first and second leg strings;

(c) opposite ends of said weft section defining third and fourth leg strings;

(d) a portion of said warp section intermediate said first and second leg strings defining a warp loop;

(e) a portion of said weft section intermediate said third and fourth leg strings defining a weft loop; and (f) each of said leg strings extending in a different direction such that a crotch is formed between each adjacent pair of leg strings, each leg string of each adjacent pair of leg strings being separated from the remaining leg string of said adjacent pair by at least one of said warp and weft loops, said warp and weft loops running in parallel with each other.

2. The fishing net of claim 1, wherein said leg strings radiate angularly from said warp and weft loops in the order first, third, second and fourth leg strings.

3. The fishing net of claim 1 or 2 wherein the shape of each of said knots is small and narrow in the net-finishing direction.

* * * * *